US010586487B2

(12) United States Patent
He et al.

(10) Patent No.: US 10,586,487 B2
(45) Date of Patent: Mar. 10, 2020

(54) DRIVING METHOD OF DISPLAY PANEL

(71) Applicant: Shenzhen China Star Optoelectronics Semiconductor Display Technology Co., Ltd., Shenzhen, Guangdong (CN)

(72) Inventors: Jian He, Guangdong (CN); Shensian Syu, Guangdong (CN)

(73) Assignee: Shenzhen China Star Optoelectronics Semiconductor Display Technology Co., Ltd, Shenzhen, Guangdong (CN)

( * ) Notice: Subject to any disclaimer, the term of this patent is extended or adjusted under 35 U.S.C. 154(b) by 0 days.

(21) Appl. No.: 15/769,106

(22) PCT Filed: Dec. 20, 2017

(86) PCT No.: PCT/CN2017/117500
§ 371 (c)(1),
(2) Date: Apr. 18, 2018

(87) PCT Pub. No.: WO2019/071833
PCT Pub. Date: Apr. 18, 2019

(65) Prior Publication Data

US 2019/0114959 A1 Apr. 18, 2019

(30) Foreign Application Priority Data

Oct. 12, 2017 (CN) ..... 2017 1 0948330

(51) Int. Cl.
*G09G 3/3225* (2016.01)
*G09G 3/20* (2006.01)
*G09G 3/3233* (2016.01)

(52) U.S. Cl.
CPC ..... *G09G 3/3225* (2013.01); *G09G 3/2022* (2013.01); *G09G 3/2074* (2013.01); *G09G 3/3233* (2013.01); *G09G 2300/0861* (2013.01); *G09G 2310/0262* (2013.01); *G09G 2320/0233* (2013.01)

(58) Field of Classification Search
None
See application file for complete search history.

(56) References Cited

U.S. PATENT DOCUMENTS

| | | | | |
|---|---|---|---|---|
| 9,406,254 | B2 | 8/2016 | Shin | |
| 2015/0062198 | A1* | 3/2015 | Shin | G09G 3/2025 345/690 |

FOREIGN PATENT DOCUMENTS

| | | | |
|---|---|---|---|
| CN | 1514426 | A | 7/2004 |
| CN | 101341525 | A | 1/2009 |
| CN | 101855664 | A | 10/2010 |
| CN | 104599637 | A | 5/2015 |
| CN | 104978925 | A | 10/2015 |
| CN | 105047139 | A | 11/2015 |
| CN | 106652963 | A | 5/2017 |
| CN | 107068048 | A | 8/2017 |
| JP | 2001013908 | A | 1/2001 |

(Continued)

*Primary Examiner* — Andre L Matthews
(74) *Attorney, Agent, or Firm* — Andrew C. Cheng

(57) ABSTRACT

The present disclosure relates to a driving method for a display panel. The method includes dividing a frame in any of sub-pixels signals of video inputting signals into a first sub-field and a second sub-field, driving the first sub-field by a first driving mode, and driving the second sub-field by a second driving mode. As such, the brightness of the display panel may be improved.

6 Claims, 6 Drawing Sheets

(56) References Cited

FOREIGN PATENT DOCUMENTS

| | | | |
|---|---|---|---|
| KR | 20090065740 | A | 6/2009 |
| WO | WO2009082056 | A1 | 7/2009 |

* cited by examiner (a)

(b)

DRIVING METHOD OF DISPLAY PANEL

BACKGROUND OF THE INVENTION

1. Field of the Invention

The present disclosure relates to display field, more particular to a driving method of display panels.

2. Discussion of the Related Art

FIG. 1 illustrates a pixel driving circuit, including three transistors and one capacitor (3T1C), of a conventional organic light emitting diode (OLED). "Data" indicates data driving signals, "Gate1" indicates charging scanning signals configured to control a transistor T1 to charge "A" point. "Gate2" indicates discharging scanning signals configured to control a transistor T3 to drive the "A" point to discharge. "OVDD" indicates constant voltage signals. "OVSS" indicates an output voltage of the OLED. "Vref' indicates a reference voltage.

With respect to the pixel driving circuit, a threshold voltage Vth of a transistor T2 may drift after a long-time operation, resulting in a non-uniform brightness of a display panel. Conventionally, a pulse-width modulation (PWM) driving mode is provided to improve the image-display of the OLED. The PWM driving mode may eliminate the non-uniform brightness problem of the display panel when comparing with an analog driving mode.

FIG. 2 is a schematic view illustrating an arrangement of sub-fields in a next frame in the conventional PWM driving mode. FIG. 2 is an example of an eight-bit (digital) driving mode, wherein X-axis indicates the time and Y-axis indicates scanning time of scanning lines. One frame may include a plurality of sub-fields SF, wherein each of the sub-fields has the same time period. The brightness of grayscale value may be displayed by a digital voltage (two Gamma voltages) via controlling charging time of the sub-field SF in conjunction with a principle of time integration of human perception of brightness.

Specifically, by controlling the charging and discharging time, each of the sub-fields SF within a pixel may have different emission time. Taking one frame divided into eight sub-fields as an example. The emission time is determined according to the weight, such as 1:1/2:1/4:1/8:1/16:1/32:1/64:1/128, to generate PWM emission signals. Although, the hardware is easy to implement in the PWM driving mode, the pixels do not illuminate at most of the time, resulting in low-brightness. For example, a ratio of the illumination time with respect to the pixel within one frame under 255 grayscale values (eight sub-fields illuminates at the same time) is at about 25%. That is, the brightness is merely 25% of the 255 grayscale values driven by analog potentials. Therefore, the brightness of the panel will be extremely dark when driven by PWM driving mode.

SUMMARY

In one aspect, the present disclosure relates to a driving method for a display panel, including: dividing a frame in any of sub-pixels signals of video inputting signals into a first sub-field and a second sub-field; driving the first sub-field by a first driving mode, and driving the second sub-field by a second driving mode.

In one example, the first driving mode is a digital driving mode, and the second driving mode is an analog potential driving mode.

In one example, the first sub-field is divided into a plurality of secondary sub-fields, and the secondary sub-fields and the second sub-field are arbitrarily arranged within the frame.

In one example, the step of arbitrarily arranging the secondary sub-fields and the second sub-field are within the frame further includes: the secondary sub-fields are respectively arranged on two lateral sides of the second sub-field within the frame; the secondary sub-fields are arranged on one side of the frame, and the second sub-field is arranged on the other side of the frame.

In one example, the display panel includes a plurality of sub-pixels arranged in a matrix, and the step of driving the second sub-field by the second driving mode further includes: driving the second sub-field by a predetermined number of the analog potential, wherein each of the analog potentials is configured to drive a driving transistor corresponding to any one of the sub-pixels in a saturation region or a linear region.

In one example, the step of driving the first sub-field by the first driving mode and driving the second sub-field by the second driving mode further includes: determining the grayscale value of any of sub-pixel signals in the video inputting signals; determining a gating method of the sub-field corresponding to the grayscale value, wherein the gating method includes a combination of the gating methods of the first sub-field and the second sub-field; driving the first sub-field by the first driving mode and driving the second sub-field by the second driving mode according to the determined gating method of the sub-field.

In one example, the step of determining the gating method of the sub-field corresponding to the grayscale value further includes: determining the gating method of the secondary sub-fields; determining a combination of the gating methods of the sub-field in one frame according to a predetermining number of an analog potential and the gating method of the secondary sub-fields; adopting the gating method of the sub-field corresponding to the grayscale value from the determined combination of the gating methods of the sub-field.

In one example, the first sub-field is arranged in a first time period of the frame and the second sub-field is arranged in a second period of the frame, the first time period is prior to the second time period, and a time period of the frame is equal to a summation of the first time period and the second time period.

In one example, the first driving mode includes a dark-state potential and a bright-state potential, and the driving method further includes: determining a proportion of the first sub-field with respect to the time period of the frame according to the bright-state potential in the first driving mode, a grayscale value that all of secondary sub-fields of the first sub-field are illuminated, the minimum grayscale value of the second sub-field, a proportion of the time period of the first sub-field with respect to pixel illumination time when all of the secondary sub-field are driven to illuminate under the first driving mode, the analog potential corresponding to the minimum grayscale value of the second sub-field, and the time period of one frame.

In one example, the proportion of the first sub-field with respect to the time period of the frame is obtained by the following equation:

$$\frac{2^{N-1}-1}{2^N} = \frac{G_2 \cdot \eta \cdot k \cdot T}{V_{gl}1 \cdot (1-k) \cdot T}$$

"$2^{N-1}-1$" indicates the grayscale value that all of the secondary sub-fields of the first sub-field are illuminated, "$2^N$" indicates the minimum grayscale value of the second sub-field, "$G_2$" indicates the illustrating-state potential of the first driving mode, "k" indicates the proportion of the first sub-field with respect to the time period of one frame, "T" indicates the time period of the one frame, "$V_{gl}1$" indicates the analog potential corresponding to the minimum grayscale value of the second sub-field, "η" indicates the proportion of the time period of the first sub-field with respect to the pixel illumination time when all of the secondary sub-field are driven to illuminate under the first driving mode, $$\text{“}\eta = \left[2 - \frac{1}{2^{N-1}}\right] \Big/ N\text{”},$$

and "N" indicates the number of the secondary sub-fields into which the first sub-field is divided.

In view of the above, the driving method for the display panel of the present disclosure may improve the brightness of the display panel.

DETAILED DESCRIPTION OF THE EMBODIMENTS

Following embodiments of the invention will now be described in detail hereinafter with reference to the accompanying drawings. However, there are plenty of forms to implement the present disclosure, and the invention should not be construed as limitation to the embodiments. Rather, these embodiments are provided to explain the principles of the invention and its practical application, thereby enabling other person skilled in the art to understand each of the embodiments in the invention and various modifications being suitable for the particular application.

The present disclosure relates to a driving method for a display panel. In one example, the display panel may be an organic light-emitting diode (OLED) display panel. The display panel may include a plurality of sub-pixels arranged in a matrix. Each of the sub-pixels may include a pixel driving circuit.

Figure 1:
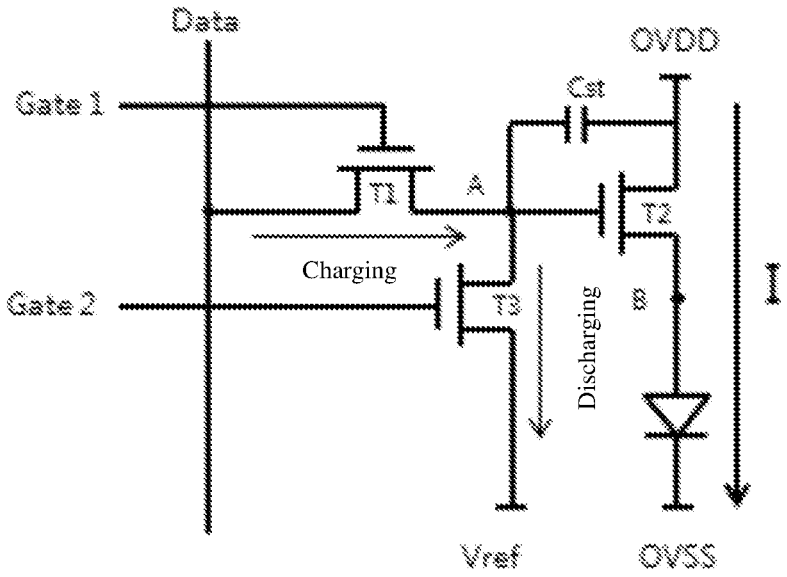
FIG. 1 (PRIOR ART)
FIG. 1 is a circuit diagram of a pixel driving circuit of a conventional organic light-emitting diode (OLED) display.
Figure 2:
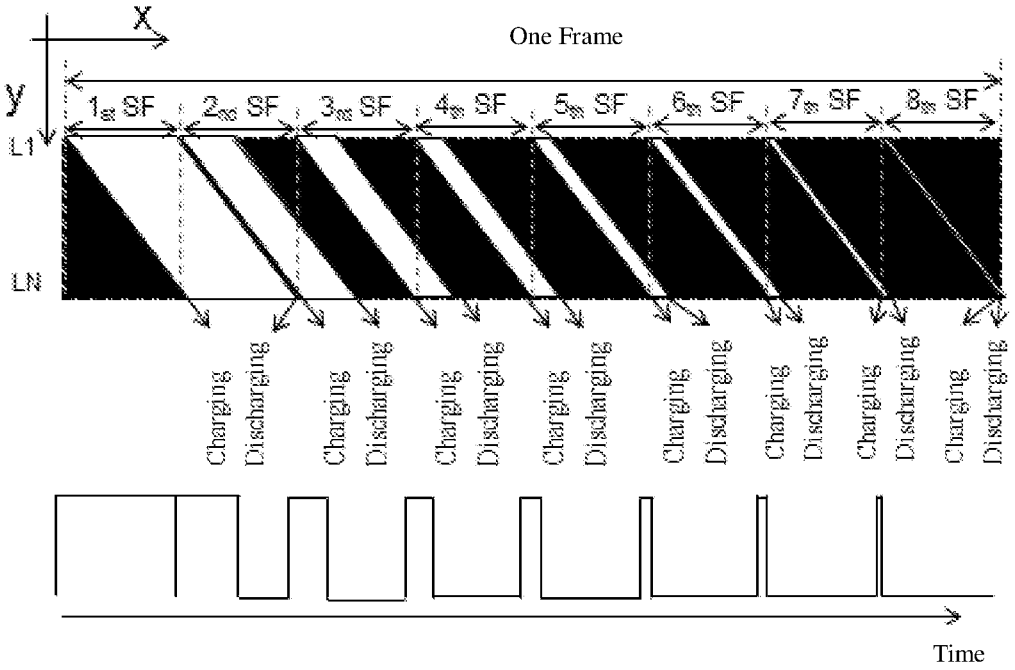
FIG. 2 (PRIOR ART)
FIG. 2 is a schematic view illustrating an arrangement of sub-fields in a next frame in the conventional pulse-width modulation (PWM) driving mode.

As shown in FIG. 1, the driving circuit of the sub-pixel in the OLED may include: a first thin film transistor (TFT) T1, a second TFT T2 (referred to as a driving TFT), a third TFT T3, a storage capacitor C, and an OLED (D).

Specifically, the second TFT T2 is configured to drive the OLED (D) to illuminate. The first TFT T1 is configured to charge a control end, i.e., "A" point, of the second TFT T2. The third TFT T3 is configured to control the control end, i.e., the "A" point, of the second TFT T2 to discharge. The storage capacitor C is configured to store a potential of the control end of the second TFT T2. Charging scanning signals (Gate1) are inputted to a control end of the first TFT T1. Data signals (Data) are inputted to a first connecting end of the first TFT T1. A second connecting end of the first TFT T1 connects to the control end of the second TFT T2. A first connecting end of the second TFT T2 connects to a positive voltage of a power supply (OVDD). A second connecting end of the second TFT T2 connects to an anode of the OLED (D). A negative voltage of the power supply (OVSS) is inputted to a cathode of the OLED (D). Discharging scanning signals (Gate2) are inputted to a control end of the third TFT T3. A reference voltage (Vref) is inputted to a first connecting end of the third TFT T3. A second connecting end of the third TFT T3 connects to the control end of the second TFT T2. One end of the storage capacitor C connects to the control end of the second TFT T2, the other end of the storage capacitor C connects to the first connecting end of the second TFT T2. In one example, the reference voltage (Vref) may be zero.

The present disclosure relates to a driving method that each of sub-fields within one frame is applied by different driving modes. That is, one sub-field is driven by one driving mode, and another sub-field is driven by another driving mode. The driving method is configured to cure detects, such as dark brightness of the display panel, of a conventional pulse-width modulation (PWM) driving mode. Brightness of the display panel may be improved.

Figure 3:
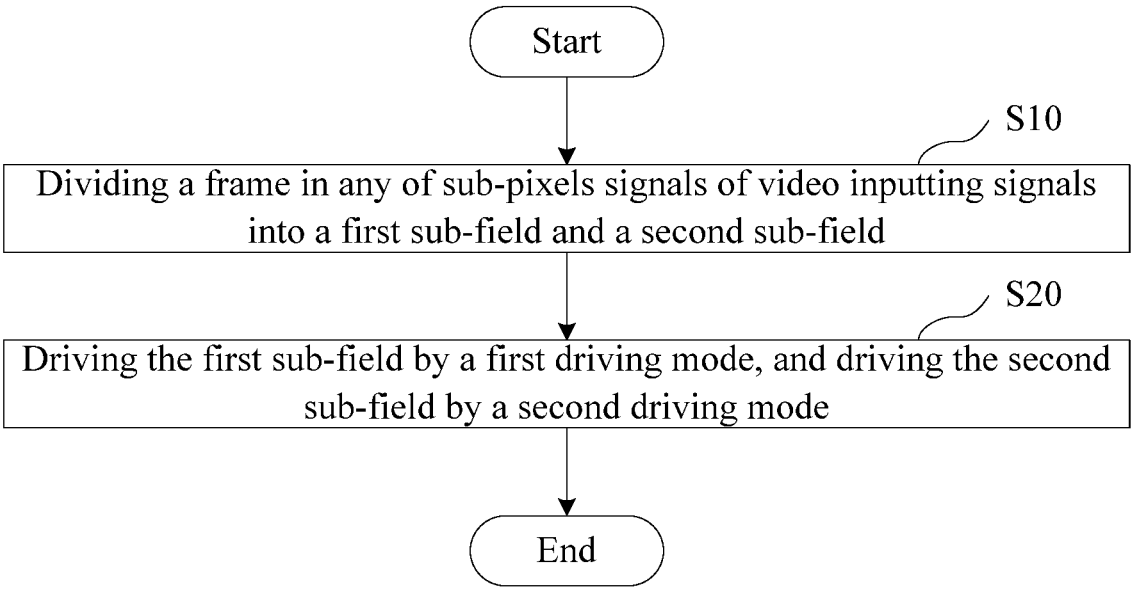
FIG. 3 is a flowchart illustrating a driving method for a display panel in accordance with one embodiment of the present disclosure.

FIG. 3 is a flowchart illustrating the driving method for the display panel in accordance with one embodiment of the present disclosure.

Referring to FIG. 3, in step S10, dividing a frame in any of sub-pixels signals of video inputting signals into a first sub-field and a second sub-field. The frame may be divided by any conventional methods.

In step S20, driving the first sub-field by a first driving mode, and driving the second sub-field by a second driving mode.

In one example, the first driving mode may be a digital driving mode, and the second driving mode may be an analog potential driving mode. The digital driving mode may be the PWM driving mode. The first sub-field is also referred to as a PWM sub-field. The second sub-field is also referred to as an analog voltage sub-field. That is, the sub-field may be driven by the digital driving mode and the analog potential driving mode.

For example, the step of driving the second sub-field by the second driving mode may include: driving the second sub-field by a predetermined number of an analog potential. Each of the analog potentials is configured to drive a driving transistor (such as the second TFT T2 shown in FIG. 1) corresponding to any one of the sub-pixels in a saturation region or a linear region.

When the PWM driving mode is turned off, and only the analog potential driving mode is turned on (That is, a plurality of secondary sub-fields are dark, and the second sub-field illuminates), a grayscale value corresponding to any one of the predetermined number of the analog potential is configured to be as:

$$GL(i)=16*i \quad (1)$$

In the equation (1), "GL(i)" indicates the grayscale value corresponding to i-th analog potential, wherein $1 \leq i \leq M$, "M" indicates the number of the analog potential.

The brightness, i.e., grayscale value, and the analog potential need to satisfy a linear relation. The brightness may be obtained based on a Gamma curve of the display panel. The predetermined number of the analog potential may satisfy the following equation:

$$V_{gl}(i) = V_{gl}1 * \left(\frac{GL(i)}{16}\right) \quad (2)$$

In the equation (2), "$V_{gl}$(i)" indicates i-th analog potential. "GL(i)" indicates the grayscale value corresponding to i-th analog potential. "$V_{gl}$1" indicates the analog potential corresponding to the minimum grayscale value within the second sub-field.

The first sub-field and the second sub-field may be arbitrarily arranged within the frame. When the first sub-field is divided into a plurality of the secondary sub-fields, the secondary sub-fields and the second sub-field may also be arbitrarily arranged within the frame. In one example, the first sub-field may be equally divided into a plurality of the secondary sub-fields. That is, each of the secondary sub-fields may have the same time period. However, the present disclosure is not limited to this. In another example, the first sub-field may be arbitrarily divided into a plurality of the secondary sub-fields. That is, the time period of the secondary sub-fields may be all different or partially the same.

In one example, an arrangement of the secondary sub-fields and the second sub-field within the frame is configured to be as the secondary sub-fields, i.e., the first sub-field, are arranged on one side of the frame, and the second sub-field is arranged on the other side of the frame.

In another example, the arrangement of a plurality of the secondary sub-fields and the second sub-field within the frame is configured to be as the secondary sub-fields within the frame are respectively arranged on two lateral sides of the second sub-field.

Figure 4:
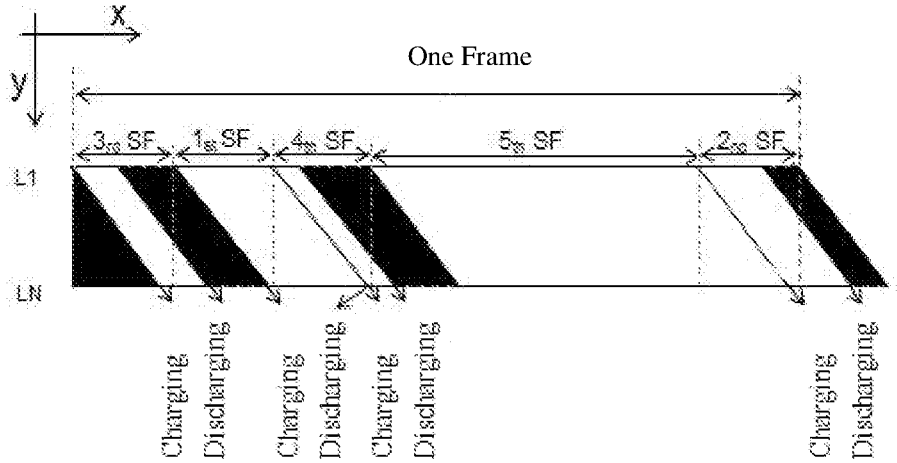
FIG. 4 is a schematic view illustrating the arrangement of the sub-fields in one frame in accordance with one embodiment of the present disclosure.
Figure 4:
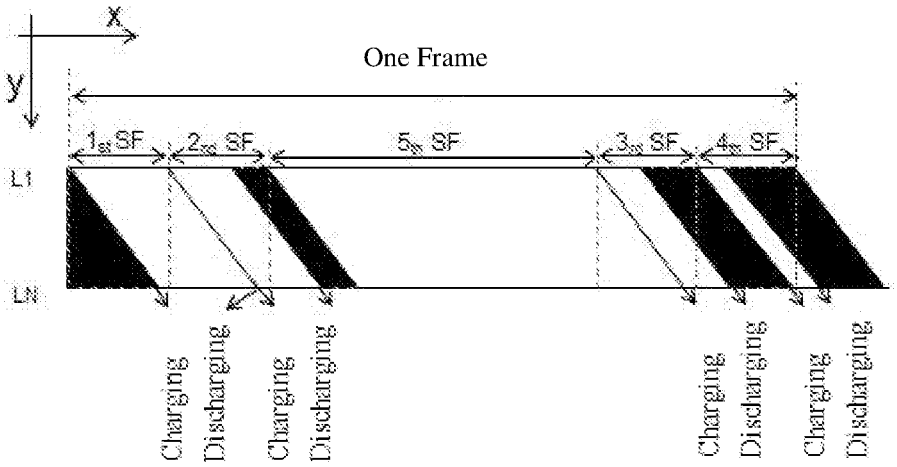

FIG. 4 is a schematic view illustrating the arrangement of the sub-fields in one frame in accordance with one embodiment of the present disclosure.

For example, as shown in FIG. 4(*a*), when the first sub-field includes four secondary sub-fields, i.e., $1_{st}$SF, $2_{nd}$SF, $3_{rd}$SF, $4_{th}$SF, one secondary sub-field includes four secondary sub-field $2_{nd}$SF) may be arranged on one side of the second sub-field (such as the second sub-field $5_{th}$SF shown in FIG. 4(*a*)), and the other three secondary sub-fields (such as secondary sub-fields $3_{rd}$SF, $1_{st}$SF, and $4_{th}$SF) may be arranged on the other side of the second sub-field. Alternatively, as shown in FIG. 4(*b*), two secondary sub-fields (such as the secondary sub-fields $1_{st}$SF and $2_{nd}$SF) may be arranged on one side of the second sub-field, and the other two secondary sub-fields (such as the secondary sub-fields $3_{rd}$SF, $4_{th}$SF) may be arranged on the other side of the second sub-field.

It is noted that the arrangements of the sub-fields shown in FIG. 4 are merely examples, and the person skilled in the art may arrange the secondary sub-fields and the second sub-field according to actual requirement.

Figure 5:
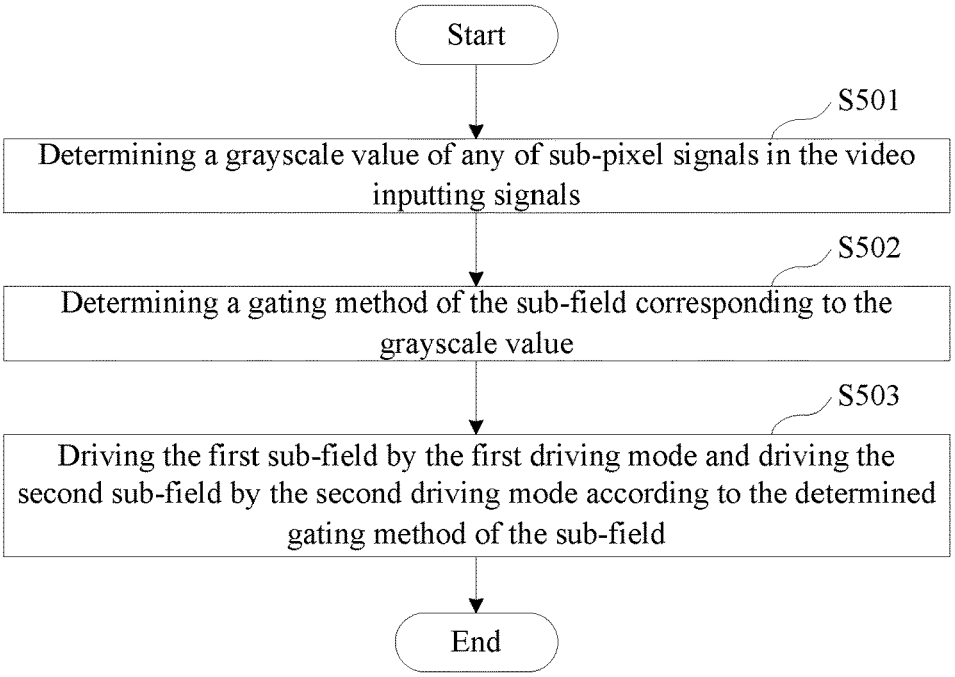
FIG. 5 is a flowchart illustrating driving steps for a first sub-field and a second sub-field in accordance with one embodiment of the present disclosure.
Figure 6:
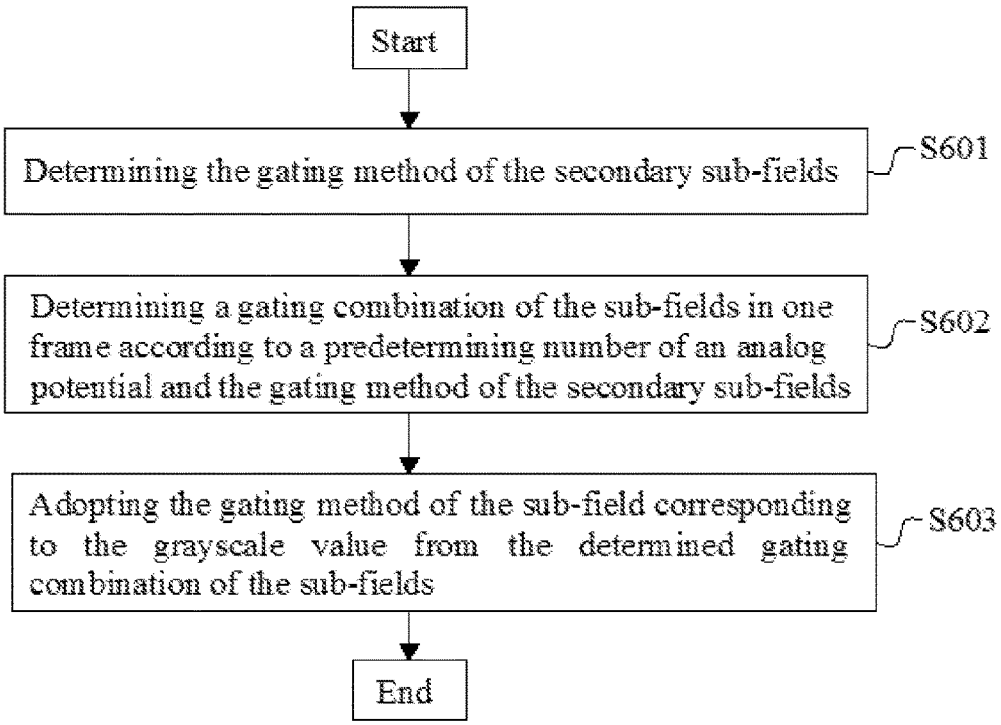
FIG. 6 is a flowchart illustrating a step of determining a gating method of the sub-field in accordance with one embodiment of the present disclosure.

FIGS. 5 and 6 illustrate the driving steps for the first sub-field and the second sub-field when the secondary sub-fields and the second sub-field are arbitrarily arranged within one frame.

FIG. 5 is a flowchart illustrating the driving steps for the first sub-field and the second sub-field in accordance with one embodiment of the present disclosure.

Referring to FIG. 5, in step S501, determining the grayscale value of any of the sub-pixel signals in the video inputting signals.

In step S502, determining a gating method of the sub-field corresponding to the grayscale value. The gating method may include a combination of the gating methods of the first sub-field and the second sub-field.

In step S503, driving the first sub-field by the first driving mode and driving the second sub-field by the second driving mode according to the determined gating method of the sub-field.

FIG. 6 is a flowchart illustrating the step of determining the gating method of the sub-field in accordance with one embodiment of the present disclosure.

Referring to FIG. 6, in step S601, determining the gating method of the secondary sub-fields. It is assumed that the first sub-field is divided into N number of the secondary sub-fields, thus the number of the gating method corresponding to the secondary sub-fields is $2^N$.

In the exemplary embodiment of the present invention, a process of driving the first sub-field and the second sub-field is described by taking the video inputting signals in eight-bit (8 bits) as an example. It is noted that the eight-bit video inputting signals is merely an example, the video inputting signals may be in other bits, such as ten-bit, and the present disclosure may not be limited to.

For example, when the video inputting signals are in 8 bits, and the first sub-field is divided into four secondary sub-fields, the number of the gating method of the secondary sub-fields may be determined to be $2^4$.

In step S602, determining a combination of the gating methods of the sub-field in one frame according to the predetermining number of the analog potential and the gating method of the secondary sub-fields.

For example, when the video inputting signals are in 8 bits, and the number of the analog potential is $2^8$, i.e., 256, there will be 256 kinds of brightness of the second sub-field driven by the analog potential. That is, the number of the analog potential may be configured to be $2^a$, wherein "a" indicates a bit number of the video inputting signals.

It is noted that when number of the gating method corresponding to the secondary sub-field is $2^N$, it is determined that there are $2^{N+8}$ kinds the combination of the gating methods of the sub-field within one frame.

In step S603, adopting the gating method of the sub-field corresponding to the grayscale value from the determined combination of the gating methods of the sub-field.

In one example, a gating list may be established according to the determined combination of the gating methods of the sub-field. The gating list may include the grayscale value, and the gating method of the secondary sub-field and the analog potential corresponding to the grayscale value.

For example, as shown in Table 1, the gating list may be formed by adopting 256 kinds of the combination of the gating methods corresponding to 256, i.e., from 0 to 255, numbers of grayscale values from the $2^{N+8}$ kinds of the combination of the gating methods of the sub-field in one frame.

TABLE 1

| Grayscale value | Gating Method of Digital Driving Mode | Analog Potential |
|---|---|---|
| 0 | 0000 | $V_{gray_0}$ |
| 1 | 0000 | $V_{gray_2}$ |
| 2 | 0001 | $V_{gray_1}$ |
| . . . | . . . | . . . |
| 254 | 1100 | $V_{gray_255}$ |
| 255 | 1111 | $V_{gray_255}$ |

It is noted that the brightness corresponding to the selected 256 kinds of the combination of the gating methods is gradually increased in accordance with an order of the grayscale value from 0 to 255.

The gating list shown in Table 1 illustrates the combination of the gating methods of the digital driving mode (such as PWM driving mode) and the analog potential driving mode corresponding to the grayscale value. For example, when receiving the video inputting signals, the combination of the gating methods corresponding to the grayscale value may be obtained from the gating list according to the grayscale value of the any of the sub-pixel signals in the video inputting signals. Images may be displayed by the driving mode of the combination of the gating methods. For example, the sub-field is driven to illuminate by the gating method of the digital driving mode corresponding to the grayscale value shown in the gating list, and the analog potential may be applied on the second sub-field corresponding to the grayscale value. As such, the brightness of the PWM driving mode and the analog potential driving mode may freely be selected, so as to improve the brightness of the display panel.

In one example, with respect to cases that the first sub-field is arranged on one side of the frame and the second sub-field is arranged on the other side of the frame, the first sub-field may be arranged in a first time period of the frame and the second sub-field may be arranged in a second period of the frame. The first time period is prior to the second time period, and a time period of the frame is equal to a summation of the first time period and the second time period. That is, the first sub-field is arranged in a high-digit portion of the frame, and the second sub-field is arranged in a low-digit portion of the frame. The second sub-field corresponding to the high-digit portion of the frame in the sub-pixel signals is driven by the analog potential driving mode, and the first sub-field corresponding to the low-digit portion of the frame in the sub-pixel signals is driven by the digital driving mode (such as PWM driving mode).

Figure 7:
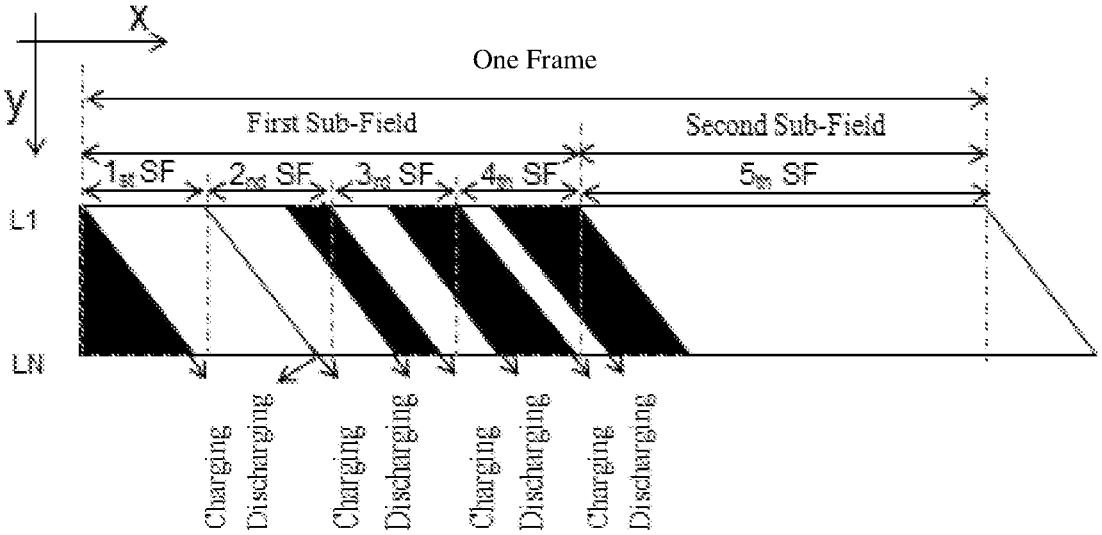
FIG. 7 is a schematic view illustrating the arrangement of the sub-field in one frame in accordance with another embodiment of the present disclosure.

FIG. 7 is a schematic view illustrating the arrangement of the sub-field in one frame in accordance with another embodiment of the present disclosure.

Referring to FIG. 7, X-axis indicates the time and Y-axis indicates the scanning time of the scanning lines. "L1" to "LQ" indicate the Q-th row of the pixel in the display panel. In one example, if the frame is divided into the first sub-field and the second sub-field, the first sub-field may be arranged in the frame for the first time period, and the second sub-field may be arranged in the frame for the second time period. The first time period is prior to the second time period. When the first sub-field is divided into four secondary sub-fields, the four secondary sub-fields may be driven by the PWM driving mode, and the second sub-field (the secondary sub-field $5_{th}$SF shown in FIG. 7) may be driven by the analog potential driving mode.

Each of the secondary sub-fields may include charging time and discharging time. A pixel charging time, i.e., illumination time of the pixel, of each of the secondary sub-fields is gradually decreased in accordance with the digit of the video inputting signals from low to high.

It is noted that the arrangement of the first sub-field and the second sub-field within the frame shown in FIG. 7 is merely an example, and the present disclosure may not be limited to this. In another example, the first sub-field may be arranged at the low-digit portion of the frame, and the second sub-field may be arranged at the high-digit portion of the frame.

The illumination time of the pixel of each of the secondary sub-fields may be controlled by controlling the charging time and the discharging time of the each of the secondary sub-fields. For example, the first driving mode may include a dark-state potential and a bright-state potential.

In one example, the driving method for the display panel may further include a step of determining a proportion of the first sub-field with respect to the time period of the frame.

Specifically, the proportion of the first sub-field with respect to the time period of the frame may be determined according to the bright-state potential in the first driving mode, the grayscale value that all of the secondary sub-fields of the first sub-field are illuminated, the minimum grayscale value of the second sub-field, a proportion of the time period of the first sub-field with respect to the pixel illumination time when all of the secondary sub-field are driven to illuminate under the first driving mode, the analog potential corresponding to the minimum grayscale value of the second sub-field, and the time period of one frame.

For example, the proportion (k) of the first sub-field with respect to the time period of the frame may be obtained by the following equation:

$$\frac{2^{N-1}-1}{2^N} = \frac{G_2 \cdot \eta \cdot k \cdot T}{V_{gl}1 \cdot (1-k) \cdot T} \tag{1}$$

In the equation (1) "$2^{N-1}-1$" indicates the grayscale value that all of the secondary sub-fields of the first sub-field are illuminated. "$2^N$" indicates the minimum grayscale value of the second sub-field. "$G_2$" indicates the illustrating-state potential of the first driving mode. "k" indicates the proportion of the first sub-field with respect to the time period of one frame. "T" indicates the time period of the one frame. "$V_{dl}$1" indicates the analog potential corresponding to the minimum grayscale value of the second sub-field. "η" indicates the proportion of the time period of the first sub-field with respect to the pixel illumination time when all of the secondary sub-field are driven to illuminate under the first driving mode, wherein $$\eta = \left[2 - \frac{1}{2^{N-1}}\right] \Big/ N,$$

and "N" indicates the number of the secondary sub-fields into which the first sub-field is divided.

The bright-state $G_2$ of the PWM driving mode may be determined according to actual parameters of the display panel. The proportion of the time period of the PWM driving mode and the analog driving mode may be obtained by the equation (1).

The driving method for the display panel of the present disclosure is configured to improve the brightness of the display panel by combining the digital driving mode (such as the PWM driving mode) and the analog driving mode.

In view of the above, the driving method for the display panel of the present disclosure is a simple way to improve the conventional PWM driving mode of the OLED. So as to reduce the number of the sub-field of the PWM driving mode, improve the brightness of the display panel, and improve practicality of the PWM drive mode.

The driving method for the display panel of the present disclosure may be achieved by computer codes stored in a computer readable recording medium. Computers may conduct the computer codes to perform the driving method described in above.

It is believed that the present disclosure is fully described by the embodiments, however, certain improvements and modifications may be made by those skilled in the art without departing from the principles of the present application, and such improvements and modifications shall be regarded as the scope of the present application.

What is claimed is:

1. A driving method for a display panel, comprising:

dividing a frame in any of sub-pixels signals of video inputting signals into a first sub-field and a second sub-field;

driving the first sub-field by a first driving mode and driving the second sub-field by a second driving mode;

wherein the first driving mode is a digital driving mode, and the second driving mode is an analog potential driving mode;

wherein the first sub-field is arranged in a first time period of the frame and the second sub-field is arranged in a second time period of the frame, the first time period is prior to the second time period, and a time period of the frame is equal to a summation of the first time period and the second time period;

wherein the first driving mode comprises a dark-state potential and a bright-state potential, and the driving method further comprises:

determining a proportion of the first sub-field with respect to the time period of the frame according to the bright-state potential in the first driving mode, a grayscale value that all of secondary sub-fields of the first sub-field are illuminated, the minimum grayscale value of the second sub-field, a proportion of the time period of the first sub-field with respect to pixel illumination time when all of the secondary sub-field are driven to illuminate under the first driving mode, the analog potential corresponding to the minimum grayscale value of the second sub-field, and the time period of one frame; and wherein the proportion of the first sub-field with respect to the time period of the frame is obtained by the following equation:

$$\frac{2^{N-1}-1}{2^N} = \frac{G_2 \cdot \eta \cdot k \cdot T}{V_{gl}1 \cdot (1-k) \cdot T}$$

wherein "$2^{N-1}-1$" indicates the grayscale value that all of the secondary sub-fields of the first sub-field are illuminated, "$2^N$" indicates the minimum grayscale value of the second sub-field, "$G_2$" indicates the illustrating-state potential of the first driving mode, "k" indicates the proportion of the first sub-field with respect to the time period of one frame, "T" indicates the time period of the one frame, "$V_{g1}1$" indicates the analog potential corresponding to the minimum grayscale value of the second sub-field, "η" indicates the proportion of the time period of the first sub-field with respect to the pixel illumination time when all of the secondary sub-field are driven to illuminate under the first driving mode, $$\text{“}\eta = \left[2 - \frac{1}{2^{N-1}}\right] \Big/ N\text{”},$$

and "N" indicates the number of the secondary sub-fields into which the first sub-field is divided.

2. The driving method according to claim 1, wherein the first sub-field is divided into a plurality of secondary sub-fields, and the first sub-fields and the second sub-field are arbitrarily arranged within the frame.

3. The driving method according to claim 2, wherein the step of arbitrarily arranging the secondary sub-fields and the second sub-field within the frame further comprises:

the secondary sub-fields are respectively arranged on two lateral sides of the second sub-field within the frame;

the secondary sub-fields are arranged on one side of the frame, and the second sub-field is arranged on the other side of the frame.

4. The driving method according to claim 1, wherein the display panel comprises a plurality of sub-pixels arranged in a matrix, and the step of driving the second sub-field by the second driving mode further comprises:

driving the second sub-field by a predetermined number of analog potentials, wherein each of the analog potentials is configured to drive a driving transistor corresponding to any one of the sub-pixels in a saturation region or a linear region.

5. The driving method according to claim 2, wherein the step of driving the first sub-field by the first driving mode and driving the second sub-field by the second driving mode further comprises:

determining a grayscale value of any of sub-pixel signals in the video inputting signals;

determining a gating method of a sub-field corresponding to the grayscale value, wherein the gating method comprises a combination of the gating methods of the first sub-field and the second sub-field;

driving the first sub-field by the first driving mode and driving the second sub-field by the second driving mode according to the determined gating method of the sub-field.

6. The driving method according to claim 5, wherein the step of determining the gating method of the sub-field corresponding to the grayscale value further comprises:

determining the gating method of the secondary sub-fields;

determining the combination of the gating methods of the secondary sub-field in one frame according to a predetermining number of an analog potential and the gating method of the secondary sub-fields;

adopting the gating method of the secondary sub-field corresponding to the grayscale value from the determined combination of the gating methods of the secondary sub-field.

* * * * *